US009217596B2

(12) United States Patent
Hall

(10) Patent No.: US 9,217,596 B2
(45) Date of Patent: Dec. 22, 2015

(54) MECHANISM FOR ICE CREATION

(75) Inventor: David L. Hall, Piedmont, SC (US)

(73) Assignee: ELECTROLUX HOME PRODUCTS, INC., Cleveland, OH (US)

( * ) Notice: Subject to any disclaimer, the term of this patent is extended or adjusted under 35 U.S.C. 154(b) by 1608 days.

(21) Appl. No.: 12/769,008

(22) Filed: Apr. 28, 2010

(65) Prior Publication Data

US 2011/0265498 A1 Nov. 3, 2011

(51) Int. Cl.
*F25C 1/08* (2006.01)
*F25C 1/20* (2006.01)

(52) U.S. Cl.
CPC ... *F25C 1/08* (2013.01); *F25C 1/20* (2013.01); *F25C 2400/10* (2013.01); *F25C 2500/06* (2013.01)

(58) Field of Classification Search
CPC ..... F25C 1/08; F25C 2500/06; F25C 1/20; F25C 2400/10; F25C 5/005; F25C 1/18; F25C 1/10
USPC ..... 62/73, 344, 345, 68, 347, 334
See application file for complete search history.

(56) References Cited

U.S. PATENT DOCUMENTS

| | | | | |
|---|---|---|---|---|
| 2,233,975 | A | 12/1939 | Epperson | |
| 3,418,823 | A * | 12/1968 | Salimbeni Vivai | 62/138 |
| 3,740,629 | A * | 6/1973 | Kohlhagen | 318/400.42 |
| 4,184,339 | A * | 1/1980 | Wessa | 62/68 |
| 4,199,956 | A * | 4/1980 | Lunde | 62/138 |
| 4,943,370 | A * | 7/1990 | Gortowski | 210/85 |
| 5,127,236 | A | 7/1992 | von Blanquet | |
| 5,187,948 | A | 2/1993 | Frohbieter | |
| 5,199,270 | A * | 4/1993 | Simkens | 62/73 |
| 5,297,394 | A | 3/1994 | Frohbieter et al. | |
| 5,845,513 | A | 12/1998 | Fornasari | |
| 6,571,567 | B2 | 6/2003 | An et al. | |
| 6,688,130 | B1 | 2/2004 | Kim et al. | |
| 6,688,131 | B1 | 2/2004 | Kim et al. | |
| 6,742,351 | B2 | 6/2004 | Kim et al. | |
| 7,017,354 | B2 | 3/2006 | Lee et al. | |
| 7,665,316 | B2 | 2/2010 | Ito et al. | |
| 2004/0083753 | A1 * | 5/2004 | Kim et al. | 62/352 |

(Continued)

FOREIGN PATENT DOCUMENTS

| | | | | |
|---|---|---|---|---|
| EP | 0364686 | | 4/1990 | |
| EP | 0364686 | A1 * | 4/1990 | F25C 1/08 |
| EP | 0794397 | | 9/1997 | |
| EP | 1925894 | A1 * | 5/2008 | F25C 1/08 |

(Continued)

OTHER PUBLICATIONS

International Search Report for PCT/EP2007/009385 dated Jan. 22, 2008, 2 pages.

*Primary Examiner* — Emmanuel Duke
(74) *Attorney, Agent, or Firm* — Pearne & Gordon LLP

(57) ABSTRACT

A refrigerator is provided that includes an apparatus for producing ice comprising a reservoir that contains water, at least one freezing member, a power source, and at least one fin located on the reservoir. The at least one freezing member is located at least partially in the reservoir. The at least one freezing member is configured for forming ice by freezing the water along the periphery of the at least one freezing member. The power source is configured to move the reservoir to create a movement of the water about the at least one freezing member. The at least one fin located on the reservoir is configured for enhancing the movement of the water about the at least one freezing member and for restricting a splashing of water from the reservoir.

4 Claims, 4 Drawing Sheets

(56) References Cited

U.S. PATENT DOCUMENTS

| | | | | |
|---|---|---|---|---|
| 2004/0107721 | A1* | 6/2004 | Choi et al. | 62/340 |
| 2006/0137382 | A1 | 6/2006 | Sasaki et al. | |
| 2006/0242986 | A1 | 11/2006 | Sugaya et al. | |
| 2007/0130982 | A1* | 6/2007 | Wang | 62/344 |
| 2009/0277191 | A1 | 11/2009 | Heger et al. | |
| 2009/0301973 | A1* | 12/2009 | Hanna | 210/723 |

FOREIGN PATENT DOCUMENTS

| | | | | |
|---|---|---|---|---|
| EP | WO2008052736 | A1 * | 5/2008 | F25C 1/10 |
| GB | 2189016 | | 10/1987 | |
| GB | 2226874 | | 7/1990 | |
| JP | 2001221543 | | 8/2001 | |
| WO | WO2008052736 | A1 * | 5/2008 | F25C 1/08 |
| WO | WO 2008052736 | A1 * | 5/2008 | F25C 1/20 |

* cited by examiner

MECHANISM FOR ICE CREATION

BACKGROUND OF THE INVENTION

The present invention relates generally to ice production, and more particularly, to ice production involving the movement of water around freezing members.

It is generally known in the prior art that ice, such as clear ice, can be produced around finger-shaped evaporators. Standard ice makers in typical domestic refrigerator/freezer machines produce ice that is visually cloudy and translucent or opaque. This is due to stagnant water that forms ice on the outer surfaces first and grows inward, thereby trapping any gasses or impurities in the water as it freezes. Even if the freezing direction is reversed, so that ice forms from the interior outward, stagnant water might not transport gases and impurities away from the advancing transition line of water freezing into ice. Thus, it may still be difficult to achieve ice that is substantially uniform, such as substantially clear.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a refrigerator includes an apparatus for producing ice comprising a reservoir that contains water, at least one freezing member at least partially located in the reservoir and configured for forming ice by freezing the water along a periphery of the at least one freezing member, a power source configured to move the reservoir to create a movement of the water about the at least one freezing member, and at least one fin. The at least one fin protrudes from a surface of the reservoir and terminates at a location within an interior of the reservoir. The at least one fin is configured for enhancing the movement of the water about the at least one freezing member and is configured for restricting a splashing of water from the reservoir.

In accordance with another aspect of the present invention, A refrigerator including an apparatus for producing ice comprising a reservoir that contains water, at least one freezing member at least partially located in the reservoir and configured for forming ice by freezing the water along a periphery of the at least one freezing member, a power source configured to move the reservoir about a rotational axis to create a movement of the water about the at least one freezing member, and a plurality of fins located on the reservoir and terminating at a location within an interior of the reservoir. The plurality of fins is configured for enhancing the movement of the water about the at least one freezing member and are configured for restricting a splashing of water from the reservoir. At least two of the plurality of fins are each mounted to the reservoir at a first vertical distance from a bottom surface of the reservoir. At least two of the plurality of fins are mounted to the reservoir at a first mounting angle and a second mounting angle, where the first mounting angle is different than the second mounting angle.

In accordance with yet another aspect of the present invention, a method of producing ice in an apparatus within a refrigerator comprises the steps of filling a reservoir with water, providing at least one freezing member located in the reservoir, activating a power source for a period of time to move the reservoir repeatedly between a first position and a second position to create a movement of the water about the at least one freezing member, and providing at least one fin at least partially located on the reservoir and terminating at a location within an interior of the reservoir. The at least one freezing member is configured for forming ice by freezing the water along a periphery of the at least one freezing member. The at least one fin is configured to enhance the movement of the water about the at least one freezing member.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
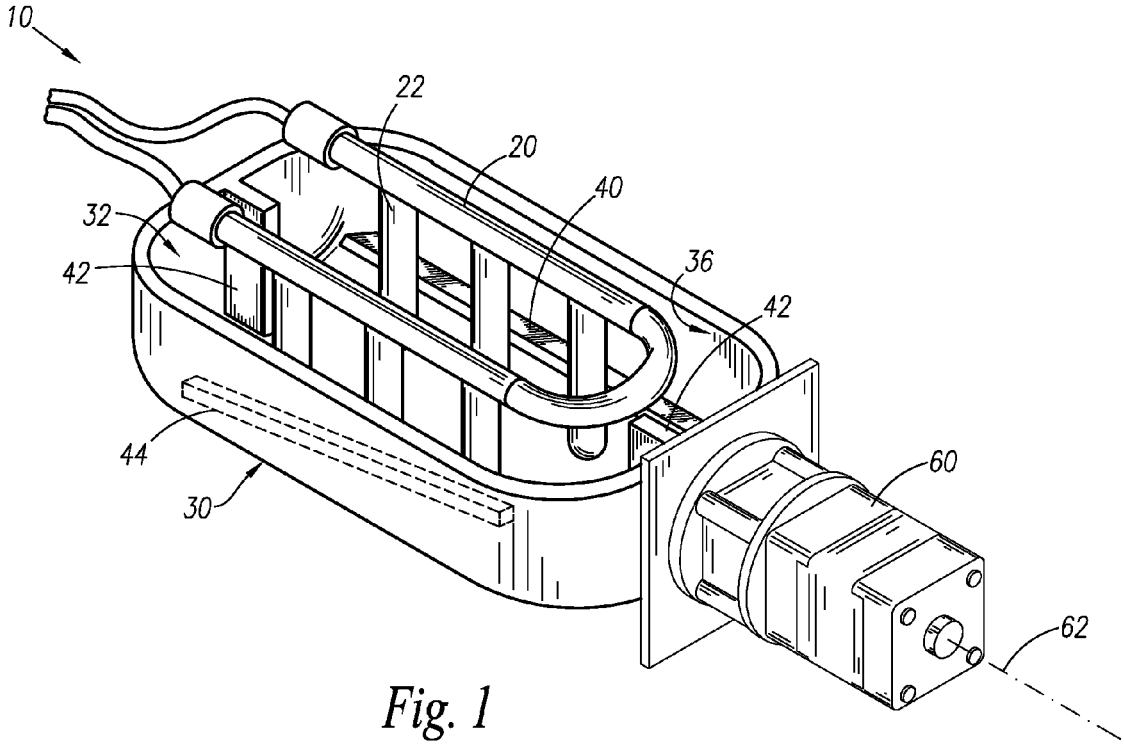
FIG. 1 is a perspective view of a first example apparatus for producing ice.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, an apparatus 10 is shown that can be used with a refrigerator, a freezer, a refrigerator/freezer, or other appliance that can produce ice, where the ice can be substantially clear and almost entirely devoid of visual occlusions. The ice maker apparatus 10 of the subject invention includes a sub-freezing element 20, such as an evaporator, that includes at least one freezing member 22 that is partially located or submerged in a reservoir 30.

The sub-freezing element 20 can include a single tube, such as an evaporator tube, that is connected to a plurality of the freezing members 22. The sub-freezing element 20 can be part of a thermoelectric cooling apparatus or part of an apparatus using another process that is capable of freezing water. The freezing members 22 is configured for forming ice by freezing the water by direct contact along the periphery of the freezing members 22. The freezing members 22 can have many different shapes, such as a finger-shaped freezing member or a cylindrical shape. Alternatively, a plate can be provided that each of the freezing members 22 extends downwardly from. Other arrangements for the sub-freezing element 20 and the freezing member 22 that are configured for forming ice can also be provided.

Figure 2:
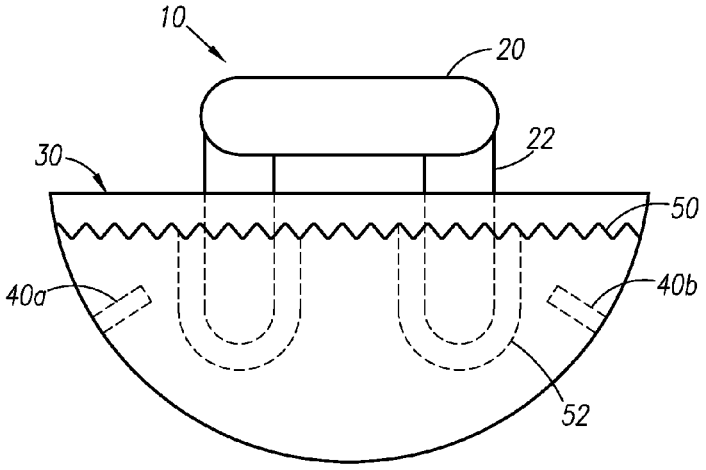
FIG. 2 is a side view of the first example of FIG. 1 where the reservoir is in a first position.
Figure 3:
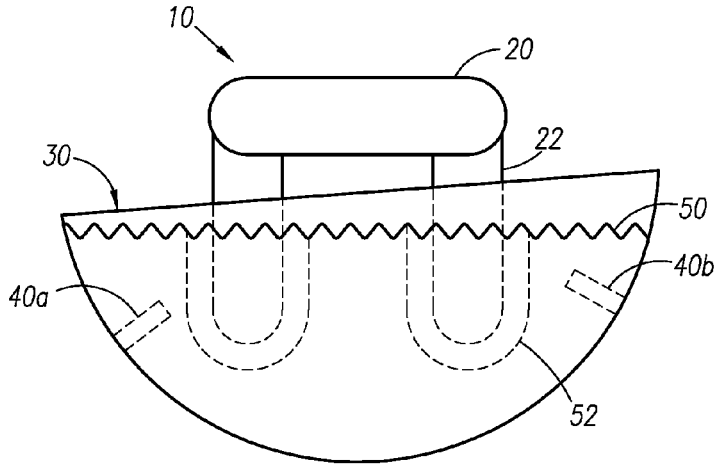
FIG. 3 is a side view of the first example of FIG. 1 where the reservoir is in a second position, rotated from the first position of FIG. 2.
Figure 4:
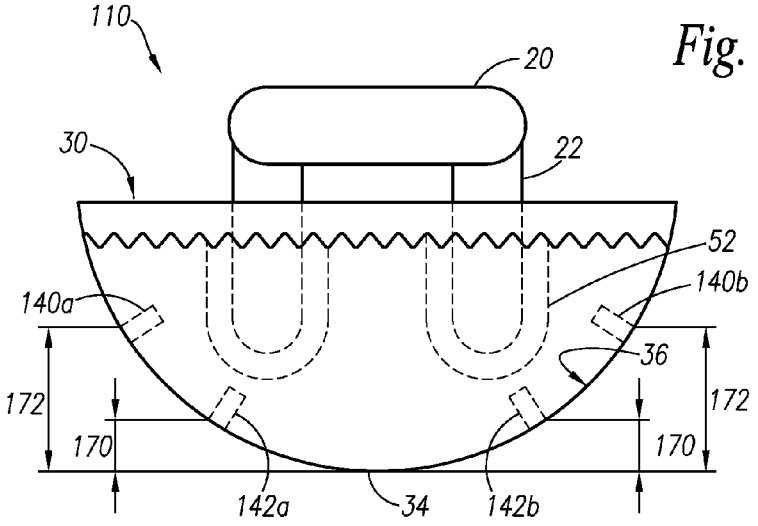
FIG. 4 is a side view of a second example apparatus for producing ice.

The reservoir 30 holds water 50, shown in FIGS. 2-4, to form ice around the freeing members 22. The reservoir 30 includes an interior 32. The interior 32 can include at least a bottom surface 34 and at least one side surface 36. The reservoir 30 can have a variety of shapes, such as a cup-like shape as shown in these figures. The reservoir 30 can also have other shapes in other examples, including a half-circular shape, an elliptical shape, or a substantially quadrilateral shape.

As shown in FIG. 1, a power source 60 is provided that is configured to move the reservoir 30 to create a movement or flow of the water about the freezing members 22. The power source 60 is connected to structure that is configured to move the reservoir 30 itself. In one example, the power source 60 can be configured to move the reservoir 30 about a rotational axis 62 between a beginning position and an ending position. In another example, the power source 60 is configured to move the reservoir 30 in various horizontal, vertical, or angular directions between various positions. In yet another example, the power source 60 is configured to move the reservoir repeatedly back and forth along an arc or a curved path between a beginning position and an ending position. Other movements can be achieved using the power source 60, such as moving the reservoir 30 repeatedly along different shaped paths and about various rotational axes between various positions. The power source 60 of the mechanical motion of the reservoir 30 can be a stepper motor. The mechanical motion of the reservoir 30 can also be provided by a DC motor with oscillation limits defined by switches or a solenoid driven linkage. In another example, the speed for the power source 60 can be powered by an unbalanced motor that is operated at a relatively high frequency.

FIG. 2 shows a first position for the reservoir 30, where the reservoir 30 is in a resting position. The power source 60 can be activated to rotate or move the reservoir from the position shown in FIG. 2 to the position shown in FIG. 3. FIG. 3 shows a second position for the reservoir 30, where the reservoir is in a rotated position. The movement of the reservoir 30 between two positions creates a movement of the water 50 while the water is freezing around the freezing members 22. Ice 52 is formed from the water 50 on the submerged portions of the freezing members 22 while the reservoir 30 is being oscillated. As the reservoir 30 is moved, such as to the position of FIG. 3, the reservoir 30 creates a movement or flow of the water 50, and the water 50 experiences inertia. The reservoir 30, which contains the water 50, can be mechanically driven in an oscillatory motion, as illustrated by FIG. 2 and FIG. 3. The oscillation of the reservoir 30 causes movement in the water 50 as the ice freezes.

As shown in FIG. 1, structure configured for enhancing the movement of water in the reservoir 30, such as a first fin 40, a second fin 42, or a third fin 44, can be located on the reservoir 30. The fins 40, 42, 44 can be located on the interior surfaces of the reservoir 30, to enhance the movement of the water about the freezing member 22. The fins 40, 42, 44 can be of various sizes and shapes that are protruding from the side surface 36 of the reservoir 30 and terminate at a location within the interior 32 of the reservoir 30. For example, the first fin 40 can extend across a substantial portion of the side surface 36 that the first fin 40 is mounted to. The first fin 40 can have a longitudinal axis that is substantially horizontal.

A second fin 42 can be provided either in addition to the first fin 40 or as an alternative to the first fin 40. The second fin 42 can extend in a generally vertical orientation. With the substantially vertical longitudinal axis, the second fin 42 can have a relatively greater angular speed at its lower portion if the rotational axis 62 is located near the top of the reservoir 30. The power source 60 can move or oscillate the reservoir 30 along a rotational axis 62 near the top portion or bottom portion of the reservoir 30.

A third fin 44 can be provided either in addition to any of the first fin 40 and the second fin 42 or as an alternative to any of the first fin 40 and the second fin 42. The third fin 44 can extend in a generally angular orientation relative to the rotational axis 62. It is appreciated that in any of the examples, the longitudinal axis of any of the fins can be horizontal, vertical, or of any other angular orientation, to achieve various desired directions of enhancement to the movement of the water 50. In one example, a fin can be provided that has a longitudinal axis that curves such that the fin is located at different vertical positions on the reservoir 30.

The fins 40, 42, 44 in each of the examples are configured to enhance and alter the movement of the water 50. The movement or flow of the water 50 is produced by the power source 60 moving the reservoir 30. The fins 40, 42, 44 are provided to enhance the movement of water on the freezing member 22. The fins 40, 42, 44 also help to ensure that the ice 52 can be substantially clear due in part to the fact that the fins 40, 42, 44 enhance the movement of water as the water is forced to move around the shape of the fins 40, 42, 44 when the reservoir 30 is in motion. The movement or flow of the water 50 is enhanced by the fins 40, 42, 44 to further transport gases and impurities away from the advancing transition line of water 50 that is freezing into ice 52. The ice 52 produced can have an improved clarity due to the movement of the reservoir 30 and the fins 40, 42, 44 helping to move gases and impurities away from the water 50 that is freezing into the ice 52.

In one example, at least one fin 40 is protruding from a side surface of the reservoir 30 towards the at least one freezing member 22. In other examples, the fins 40, 42, 44 can protrude inwards in other directions and terminate at any location within the interior of the reservoir 30. Alternate locations and orientations for the fins 40 can be employed in each of the examples and each of the figures. The fins 40, 42, 44 can be formed of solid structures or can be at least partially hollow. The fins 40, 42, 44 can also be securely attached to the interior surface 36 of the reservoir 30 and may be removable and/or adjustable, or alternatively the fins 40, 42, 44 can be molded into the reservoir 30 as it is formed with the reservoir 30 as part of a molding process.

The fins 40, 42, 44 can also be configured for restricting, such as preventing, a splashing of water from the reservoir 30. The fins 40, 42, 44 can act as restrictors by impeding or restricting the motions of the waves of water that are formed by the movement of the reservoir 30. In one example, the first fin **40*b* shown in FIG. 3 can help contain a portion of a wave of water between the base of the first fin 40*b* and the reservoir 30 itself. Without the fins 40, 42, 44 being present in the reservoir 30, there is a greater chance that the waves of water will continue to move along the interior of the reservoir during the movement of the reservoir and a portion of water could end up being spilled from the reservoir 30. It is to be understood that any or all of the fins described herein can be adapted to restrict splashing of water from the reservoir 30**.

The fins 40, 42, 44 in any of the examples also can each have different shapes. For example, the fins 40 in the shown drawings are generally quadrilaterals but other shapes including those with curves, can also be used. The fins 40, 42, 44 can further have different shapes along each portion of the fin 40, 42, 44. For example, a portion of the fin can have a quadrilateral shape and an end of the fin can have various curved shapes and profiles or a different kind of quadrilateral shape. Other orientations for the longitudinal axis of each of the fins 40, 42, 44 can also be used.

In a second example apparatus 110, shown in FIG. 4, a first pair of fins 140*a*, 140*b* can be located at the same corresponding vertical positions along each side surface 36 of the reservoir 30 to provide a similar amount of enhancement to the movement of the water during each oscillation of the reservoir 30. Thus, in FIG. 4, a first pair of fins 140*a*, 140*b* is located at the same first vertical distance 170 from the bottom surface 34 of the reservoir 30. A second pair of fins 142*a*, 142*b* can be provided that are located at the same second vertical distance 172 from the bottom surface of the reservoir 30. In further examples, each pair of fins, such as the lowest fin 140*a*, 140*b* on each side surface 36, can be located at varying or different vertical distances from the bottom surface 34 of the reservoir 30. At least two fins can also be provided at different vertical distances from the bottom surface of the reservoir 30. In another example, the fins along each side surface 36 can be randomly distributed at various vertical distances. In further examples, various sizes of fins can be used where each varying size is placed at a different distance from the bottom surface 34.

Figure 5:
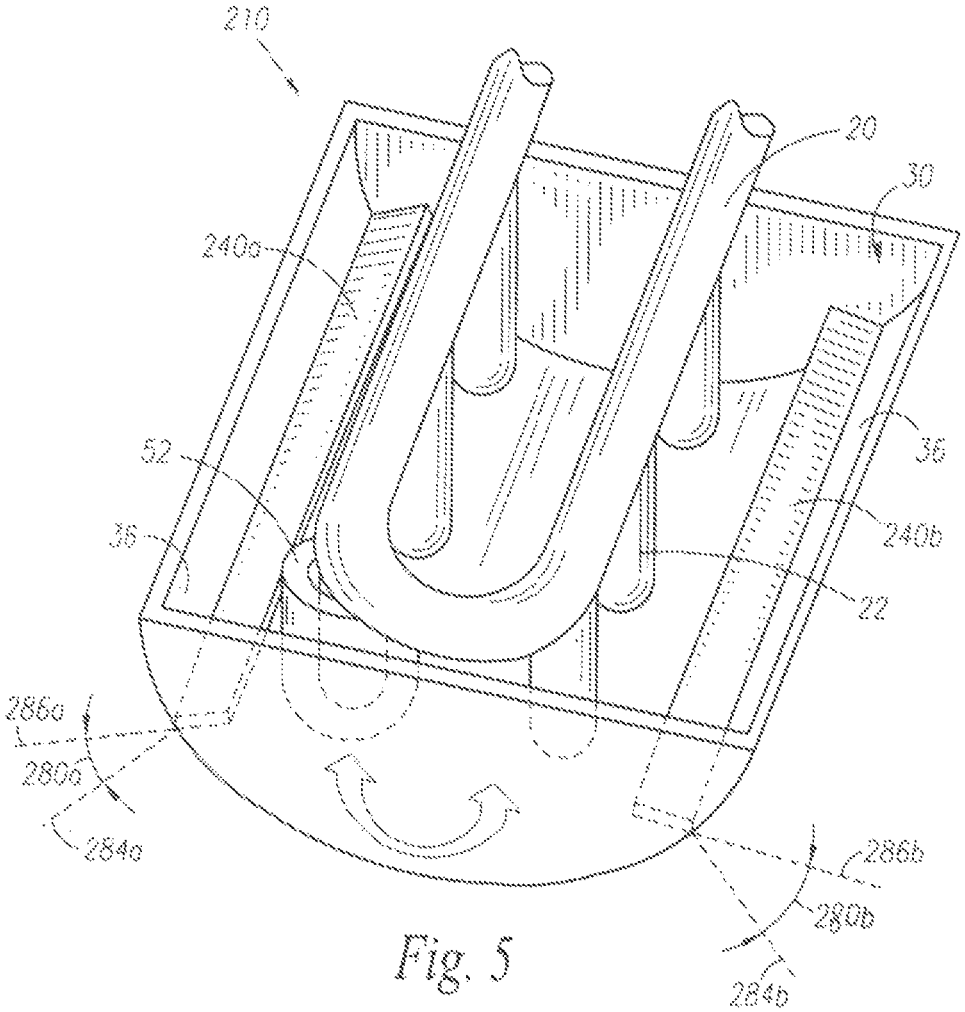
FIG. 5 is a perspective view of a reservoir of a third example apparatus for producing ice.

As shown in a third example apparatus 210 of FIG. 5, the fins can also be placed at varying orientations. In the third example, a first fin 240*a* can be mounted to the reservoir at a first mounting angle 280*a* that is different than a second mounting angle 280*b* of a second fin 240*b*. The mounting angle 280*a*, 280*b* is the angle between a normal 284*a*, 284*b* at the point that the fin 240*a*, 240*b* is attached to the side surface 236 of the reservoir 230 and a lateral axis 286*a*, 286*b* of the fin 240*a*, 240*b*. Thus, in this example, the first mounting angle 280*a* is measured as the angle between the lateral axis 286*a* of the fin 240*a* and the normal 284*a* that is perpendicular to the point that the fin 240*a* is attached to the side surface 236. In the third example of FIG. 5, the first fin 240*a* can be placed at a mounting angle 280*a* that is smaller than the mounting angle 280*b* of the second fin 240*b*. The smaller mounting angle 280*a* of the first fin 240*a* results in the first fin 240*a* being placed closer to a vertical orientation than the second fin 240*b*. The mounting angle 280*a*, 280*b* of each fin 240*a*, 240*b* can be used to direct the movement of water to a specific location, such as to the location of a freezing member 22.

It is appreciated that in other examples, the freezing members 22 can be located in various arrangements and in various numbers. Alternatively, various mounting angles can be provided for the fins 240*a*, 240*b* to create different directions of enhancement to the movement of water 250 about the freezing member 22. In further examples, a plurality of fins 240*a*, 240*b* can be provided with various mounting angles such that there are incremental increases or decreases in the mounting angle as one proceeds along the interior surface of the reservoir 30.

Figure 6:
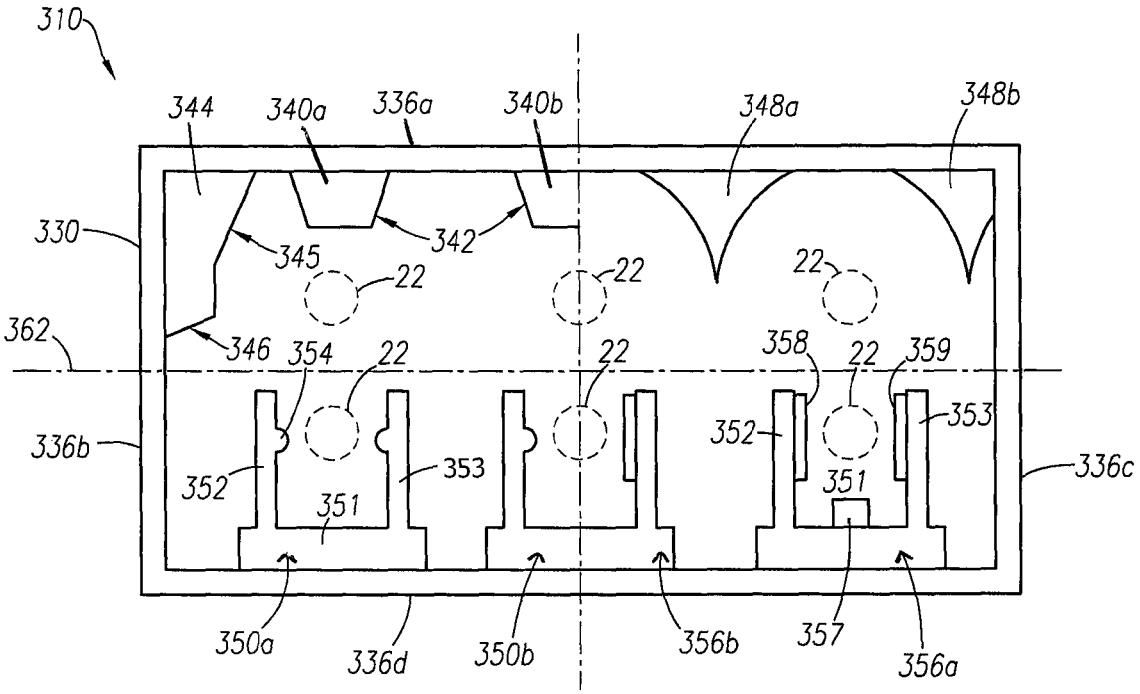
FIG. 6 is a top view of a fourth example apparatus for producing ice.

As shown in a fourth example apparatus 310 in FIG. 6, a variety of different kinds of fins 340*a*, 340*b*, 344, 348*a*, 348*b*, 350*a*, 350*b*, 356*a*, 356*b* can be provided. For clarity, the fourth example apparatus 310 is shown divided by the rotational axis 362 and a vertical line to provide four quadrants that each include different types of example fins. In further examples, the apparatus 310 could include just one type of the example fins or could include any combination of different types of fins, including any type of fin discussed herein. It is to be understood that any or all of the fins described herein can be adapted to restrict splashing of water from the reservoir 330.

A plurality of first type fins 340*a*, 340*b* can be provided as shown in the upper-left quadrant of FIG. 6. The first fin 340*a* can include an angled sidewall 342. The angled sidewall 342 is configured to direct a portion of water about freezing member 22. The angled sidewall 342 can have a variety of angles to direct water in various directions during the movement of the reservoir 330.

A second type fin 344 can be provided in the fourth example apparatus 310, as also shown in the upper-left quadrant of FIG. 6. The second fin 344 can be provided along a first side surface 336*a* and along a second side surface 336*b*. The second fin 344 can include a first angled sidewall 345 and a second angled sidewall 346. The angled sidewall 345, 346 can have a variety of angles to direct water in various directions.

Moving on, as shown in the upper-right quadrant of FIG. 6, a plurality of third fins 348*a*, 348*b* can also be provided in the fourth example apparatus 310. The third fins 348*a*, 348*b* include sidewall portions that include a curvature. The curvature of the sidewall can be convex or concave. In addition, the sidewall portions can have a combination of convex and concave portions.

Moving on, as shown in the lower-left quadrant of FIG. 6, a plurality of fourth fins 350*a*, 350*b* can also be provided in the fourth example apparatus 310. The fourth fins 350*a*, 350*b* can include a first portion 351, a second portion 352, and a third portion 353. The second portion 352 and the third portion 353 extend from the first portion 351 towards the freezing member 22. The first portion 351, the second portion 352, and the third portion 353 can substantially surround or envelope the freezing member 22 to provide a targeted enhancement of the movement of the water about the at least one freezing member 22. Alternatively, a fourth portion (not shown) can be provided to surround the freezing member 22 on each side.

In addition, the second portion 352 and the third portion 353 can further include a protrusion 354. The protrusion 354 is provided to direct a portion of water directly at the freezing member 22. Alternatively, the protrusion 354 can be directed to enhance the movement of the water about the immediate periphery of the freezing member 22. The protrusion 354 can have a curvature, such as the semi-circular portion shown. Alternatively, the protrusion 354 can be convex, concave, or have portions that are convex and portions that are concave. Alternatively, the protrusion 354 can have various geometric shapes and have various angled portions.

Moving on, as shown in the lower-right quadrant of FIG. 6, a plurality of fifth fins 356*a*, 356*b* can also be provided in the fourth example apparatus 310. The plurality of fifth fins 356*a*, 356*b* include a first portion 351, a second portion 352, and a third portion 353 in the same manner as the fourth fins 350*a*, 350*b*. The fifth fin 356*a* can further include a first flexible portion 357 configured to undulate in response to movement of the reservoir 330, in various controlled or uncontrolled manners. For example, as the reservoir 330 is rotated about the rotational axis 362, the first flexible portion 357 can be connected by a hinge to the first portion 351 to provide an undulating movement and further enhance the motion of the water about the freezing member 22. Alternatively, the first flexible portion 357 can be attached in a variety of manners (e.g., molding, over-molding, welding, fasteners, adhesives, etc.) and/or can have relatively more flexible properties than the other portions of the fin 356*a*. In a further example, a second flexible portion 358 and a third flexible portion 359 can also be provided relative to the second portion 352 and the third portion 353. In addition, a flexible portion 357 can be added to any of the other fins in any of the other examples.

In yet another example, a first fin 340*a* can be mounted on a first side surface 336*a* of the reservoir 330, a second fin 344 can be mounted on a second side surface 336*b* of the reservoir 330, a third fin 348*b* can be mounted on a third side surface 336*c* of the reservoir 330, and a fourth fin 350*a* can be mounted on a fourth side surface 336*d* of the reservoir 330. Alternatively, the same kind of fin can be mounted on each of the side surfaces 336*a*, 336*b*, 336*c*, 336*d*. In still further examples, any of the features of any of the fins from any of the example apparatuses 10, 110, 210, 310 can be combined in any one apparatus.

In one example method of operating the apparatus 10, a relatively low amplitude cycle of movement for the reservoir 30 can be used. For example, a relatively low amplitude cycle for the apparatus can include rotating the reservoir 30 only 5°-10° about the rotational axis. While the reservoir 30 is moved in the low amplitude cycle, a relatively high frequency can be provided for the motion of the reservoir 30. Thus, the reservoir 30 can be moved rapidly in a 5°-10° motion about the rotational axis 62. For example, the reservoir 30 can undergo minimal displacement between a first position and a second position that are located relatively close together. In a lower amplitude cycle with a larger frequency, the reservoir 30 rotates only a few degrees. The high frequency oscillation of the reservoir combined with the relatively low amplitude is configured such that the fins 40 further enhance the movement of the water and provide additional agitation to eliminate impurities from the water as the water is freezing. At the same time, at least one of the fins 40 can be configured to inhibit splashing of water to reduce the amount of water that is lost from the reservoir 30.

In another example method of operating the apparatus 10, a relatively high amplitude cycle of movement for the reservoir 30 can be used. For example, a relatively high amplitude cycle for the apparatus can include rotating the reservoir 30 in a motion that is greater than 10° about the rotational axis 62. While the reservoir 30 is moved in the high amplitude cycle, a relatively lower frequency can be provided for the motion of the reservoir 30. Thus, the reservoir 30 can be moved slowly in a larger motion about the rotational axis 62. For example, the reservoir 30 can undergo a large displacement between a first position and a second position that are located relatively far apart. In a high amplitude cycle with minimal frequency, the reservoir 30 rotates a large number of degrees at a very slow speed. The low frequency oscillation of the reservoir combined with the relatively high amplitude is configured such that the fins 40 further enhance the movement of the water and provide additional agitation to eliminate impurities from the water as the water is freezing. At the same time, at least one of the fins 40 can be configured to inhibit splashing of water to reduce the amount of water that is lost from the reservoir 30.

The subject invention can further include structure to allow dispensing of the ice 52, once the ice 52 has formed. The dispensing of the ice 52 can be activated after a set period of time that can be user-controlled or set by the apparatus itself. Alternatively, the dispensing of ice can be activated after a variable period of time as activated by a user or by the apparatus. Thus, the power source that moves the reservoir repeatedly between a first position and a second position can be de-activated after a set period of time. The dispensing of the ice 52 can, for example, occur anywhere between 15 and 45 minutes after the ice formation process has begun when a user activates the filling of the reservoir with water.

An example method for producing and dispensing ice 52 from the apparatus 10 is also provided. The method includes the steps of filling the reservoir 30 with water 50 and providing at least one freezing member 22 located in the reservoir 30 where the at least one freezing member 22 is configured for forming ice 52 by freezing the water 50 along a periphery of the at least one freezing member 22. The method further includes the step of activating a power source 60, such as a stepper motor, for a period of time to move the reservoir repeatedly between a first position and a second position to create a movement of the water about the at least one freezing member 22. The method also includes the step of providing at least one fin 40, 42, 44, 140*a*, 140*b*, 142*a*, 142*b*, 240*a*, 240*b*, 340*a*, 340*b*, 342, 344*a*, 344*b*, 346*a*, 346*b*, 348*a*, 348*b* located on the reservoir 30 and terminating at a location within an interior 32 of the reservoir 30, that is configured to enhance the movement of the water 50 about the at least one freezing member 22.

In one example of a dispensing operation, an example method can further include the step of removing the remaining water 50 from the reservoir 30, such as by dumping or pumping the water 50 out of the reservoir 30 after the ice has formed along the periphery of the at least one freezing member 22. Once the water 50 is pumped out, the reservoir 30 can be rotated about a rotational axis 62, such as by activating the power source 60, to allow the ice to fall off of the freezing members 22 and into a receiving area (not shown). For example, the ice can fall off the freezing members 22 to be received into a chute for selective dispensing to a user. Alternatively, the ice from the freezing members 22 can be received in a typical ice bin inside the freezing compartment.

The method can include the step of heating at least one freezing member 22 to release the ice formed on the at least one freezing member 22. Various heating structures can be provided on the freezing members 22 to facilitate dispensing of the ice, such that the ice 52 will be released from the periphery of the freezing member 22. For example, a heating structure or other heat-producing device can be located on the at least one freezing member 22. The heating structure can then be activated to warm the periphery of the at least one freezing member 22. This heat causes the ice to release from the at least one freezing member 22, as the ice is no longer frozen on the at least one freezing member. Alternatively, a reverse refrigerator cycle can also be used to harvest the ice by providing hot gas that bypasses a condenser and is instead transported through the freezing member 22. The hot gas will cause the release of the ice 52 from the periphery of the freezing member 22. Other types of dispensing methods can also be used in combination with the subject invention. In further examples, the dispensing of the ice can be actuated based on various controls or inputs, such as the door to the appliance being opened.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A method of producing ice in an apparatus within a refrigerator comprising the steps of:

filling a reservoir with water;

providing at least one freezing member at least partially located in the reservoir where the at least one freezing member is configured for forming ice by freezing the water along a periphery of the at least one freezing member;

activating a power source for a period of time to move the reservoir repeatedly between a first position and a second position to create a movement of the water about the at least one freezing member;

providing at least one fin located on the reservoir and terminating at a location within an interior of the reservoir, the at least one fin being configured to enhance the movement of the water about the at least one freezing member; and moving the reservoir according to a first cycle and a second cycle, wherein in the first cycle, the reservoir is moved at a first amplitude and a first frequency, the first amplitude being greater than or equal to 5° and less than or equal to 10°, and wherein in the second cycle, the reservoir is moved at a second amplitude and a second frequency, the second amplitude being greater than 10° and the second frequency being less than the first frequency.

2. The method of claim 1, further comprising the steps of:

removing the water out of the reservoir after the ice has formed along the periphery of the at least one freezing member;

activating the power source to rotate the reservoir about an axis; and heating the at least one freezing member to release the ice formed on the at least one freezing member.

3. The method of claim 2, wherein the step of removing the water comprises the step of pumping the water out of the reservoir.

4. The method of claim 1, further comprising the step of providing a second fin located on the reservoir and terminating at another location within the interior of the reservoir, the second fin being configured to inhibit splashing of the water to reduce an amount of the water that is lost from the reservoir when the reservoir is moved.

* * * * *